US006196832B1

(12) United States Patent
Mifune et al.

(10) Patent No.: US 6,196,832 B1
(45) Date of Patent: Mar. 6, 2001

(54) COMBUSTION WICK FOR LIQUID FUEL COMBUSTION APPLIANCE

(75) Inventors: Hideo Mifune; Yasuaki Nakamura; Masato Seki; Takashi Tsukamoto, all of Shizuoka-ken (JP)

(73) Assignee: Tokai Corporation, Tokyo (JP)

( * ) Notice: Subject to any disclaimer, the term of this patent is extended or adjusted under 35 U.S.C. 154(b) by 0 days.

(21) Appl. No.: 09/242,600

(22) PCT Filed: Jun. 17, 1998

(86) PCT No.: PCT/JP98/02671

§ 371 Date: Feb. 19, 1999

§ 102(e) Date: Feb. 19, 1999

(87) PCT Pub. No.: WO98/59200

PCT Pub. Date: Dec. 30, 1998

(30) Foreign Application Priority Data

Jun. 23, 1997 (JP) ..... 9-165850
Aug. 22, 1997 (JP) ..... 9-226213

(51) Int. Cl.[7] ..... F23Q 2/02; F23Q 2/44; F23D 3/24

(52) U.S. Cl. ..... 431/129; 431/325; 431/315; 431/153; 431/86; 431/35; 126/45; 126/96; 239/50

(58) Field of Search ..... 431/129, 130, 431/344, 150, 146, 315, 325, 288, 289, 290, 126, 152, 143; 126/96, 43, 45; 239/44, 45, 49, 50

(56) References Cited

U.S. PATENT DOCUMENTS 2,301,453 * 11/1942 Reich ..... 431/150
2,774,235 * 12/1956 Ruetz ..... 431/325
2,829,511 * 4/1958 Oesterle et al. ..... 431/325
3,428,409 * 2/1969 Summers ..... 431/289
3,462,235 * 8/1969 Summers ..... 431/325
4,416,616 * 11/1983 Shimizu et al. ..... 431/325
4,518,347 * 5/1985 Sonetaka et al . ..... 431/325
4,526,530 * 7/1985 Menter et al. ..... 431/146
4,557,687 * 12/1985 Schirneker ..... 431/325
4,611,986 * 9/1986 Menter et al. ..... 431/325
5,211,553 * 5/1993 Menter ..... 431/325

FOREIGN PATENT DOCUMENTS 2 651 861 * 3/1991 (FR) .

OTHER PUBLICATIONS

Microfilm of the specification and drawings annexed to the request of Japanese Utility Model Application No. 57456/1990 (Laid–open No. 17247/1992) (Gakken Co., Ltd.), Feb. 13, 1992, Full text; Figs. 1 to 5 (Family: none).

International Search Report, PCT/JP98/02146.

* cited by examiner

*Primary Examiner*—Ira S. Lazarus
*Assistant Examiner*—Josiah C. Cocks
(74) *Attorney, Agent, or Firm*—BakerBotts, LLP

(57) ABSTRACT

A liquid fuel burner has a wick for drawing up by capillarity of a draw-up section liquid fuel composed mainly of alcohol contained in a fuel tank and for burning it at a tip flame-producing section, a wick holder for holding the wick, an igniter for lighting the wick and a closure cap for preventing evaporation capable of sealing the wick openably and closably, and a flame-producing section of the wick is made noncircular in cross-sectional shape to increase the surface area exposed above the wick holder.

14 Claims, 7 Drawing Sheets

COMBUSTION WICK FOR LIQUID FUEL COMBUSTION APPLIANCE

TECHNICAL FIELD

This invention relates to a wick that, in a cigarette lighter, fire-lighting device or other burner using a liquid fuel composed mainly of alcohol, utilizes capillary attraction to draw up from a fuel tank liquid fuel to be burned.

BACKGROUND TECHNOLOGY

An alcohol fuel such as ethyl alcohol, a benzine fuel of the petroleum benzin type including gasoline or a liquid gas fuel such as butane gas or propane gas is generally used as the fuel of a cigarette lighter, fire-lighting device, torch, lamp or other such burner.

The performance, ease of use, and structural design of such burners differs depending on the kind of fuel used, and each has its own characteristics.

In the case of a benzine fuel that is a mixture of petroleum benzin-type hydrocarbon compounds, for example, the fuel is a mixture of compounds with different boiling points. After the burner is lit, volatilization of the components begins with the low-boiling-point benzine components and then progressively shifts to hydrocarbons with higher boiling points. Since the composition of the fuel remaining in the burner therefore varies over the burning period, the flame length changes. The same is true of gasoline. As benzine and gasoline have high volatility, burners that use them require a sealed structure for reducing evaporation from the fuel storage section and the wick portion. If the sealing is insufficient, fuel is lost through evaporation and the frequency of bothersome fuel refills increases. In addition, benzine and gasoline have distinctive odors which may be found disagreeable.

In the case of a liquid gas fuel, the gas pressure is high in the use temperature range of the burner and the vessel storing the fuel has to have a pressure-resistant structure. Moreover, the flame length changes with variation in the gas pressure and since it is a characteristic of the gas pressure to vary logarithmically and greatly with temperature, large change in flame length with temperature becomes a particular problem. In order to reduce this flame-length variation, the fuel supply system of the burner requires a special design countermeasure for effecting temperature compensation, which complicates the structure and is disadvantageous from the aspect of cost.

As regards an alcohol fuel, on the other hand, a liquid fuel composed mainly of alcohol, e.g., a lower monovalent alcohol such as methyl alcohol, ethyl alcohol or propyl alcohol, is a liquid at ordinary temperatures and is also relatively low in vapor pressure. The fuel storage section therefore does not require a pressure-resistant vessel and the sealing structure for sealing the fuel tank and the wick need only be capable of preventing alcohol evaporation. This is advantageous from the point of simplifying the structure and lowering the cost of the burner.

Further, in the burner using a liquid fuel composed mainly of alcohol, the means used to supply the liquid fuel from the fuel storage section to the flame-producing section is generally a wick that, utilizes the surface tension of the liquid fuel to draw it up through continuous fine holes or fine voids among bundled thin fibers by capillarity and burns it at the tip portion thereof.

Specifically, the wick used for drawing up the fuel is a string-like one obtained by twisting fibers, one obtained by bundling glass fibers, one using both of these with the glass fibers enclosed in cotton yarn and the result wound with fine metal wires to prevent disintegration, or the like, whose lower draw-up section functions to draw up fuel to be burned at the upper flame-producing section.

In the burner using a wick of the foregoing type, moreover, the initial flame length after lighting, the change in flame length, the saturated flame length and the like differ depending on the material, size and shape of the wick. The burner must therefore be configured to provide the desired characteristics.

In the case of a cigarette lighter or other burner fabricated to use a liquid fuel composed mainly of alcohol, fuel present on the wick surface starts to burn and form a flame after the wick is lit. The length of this flame will be called the initial flame length.

This wick is then heated as the burning continues. As the amount of fuel vaporized from the surface of the wick therefore increases, the flame grows longer. As the burning proceeds, however, the temperature rise produced by the burning of fuel on the wick reaches a state of equilibrium and stops. The growth of the flame length also saturates and stops at the saturated flame length. As the fuel burns/vaporizes from the surface of the wick, fuel disperses from the interior of the wick to the surface thereof and is replenished by fuel drawn up from the fuel tank through the draw-up section of the wick.

When fuel is consumed from the wick surface, fuel is supplied from the wick interior and fuel is drawn up and supplied from the fuel tank, the fuel stays in a state of equilibrium and the flame length stabilizes. If the consumption of fuel from the surface of the wick is not accompanied by a corresponding supply of fuel from the wick interior, the flame length changes from the initial flame length and the state of equilibrium with the fuel supply is lost.

In a cigarette lighter, fire-lighting device or other such burner, the burning conditions that must be satisfied are that the initial flame length immediately after lighting be maximized, a practical length being at least around 20 mm, that the time for the flame length to reach 25 mm be minimized, i.e., be made not more than 10 seconds from the practical viewpoint, and that the saturated flame length with passage of time after lighting be kept from becoming too long, i.e., be kept to around 70 mm from the practical viewpoint.

To achieve these conditions with a wick of circular cross section, however, the amount of projection of the wick from the wick holder has to be made large if the outer diameter of the wick is made small, while if the amount of projection is to be reduced, the outer diameter has to be made large. In either case, the structure is difficult to make compact because of considerations relating to the size and opening/closing operation of the closure cap for preventing evaporation of fuel from such a wick. The preferred structure is one that minimizes both the size of the wick and the amount of wick projection.

In view of the foregoing circumstances, the present invention is aimed at providing a wick for a liquid fuel burner, particularly a burner that uses a liquid fuel composed mainly of alcohol and that enables minimal wick projection amount and compact configuration while ensuring optimum burning conditions.

DISCLOSURE OF THE INVENTION

The invention liquid fuel burner wick, which overcomes the problems set out in the foregoing, is characterized in that, it comprises a wick for drawing up by capillarity of a draw-up section liquid fuel composed mainly of alcohol contained in a fuel tank and for burning it, at a tip flame-producing section, a wick holder for holding the wick, an igniter for lighting the wick and a closure cap for preventing evaporation capable of sealing the wick openably and closably, characterized in that the flame-producing section of the wick is noncircular in cross-sectional shape.

The noncircular cross-sectional shape of the flame-producing section of the wick is preferably formed to be elliptical, square or the like.

In this case, as regards securement of the surface area needed to obtain a prescribed initial flame length and other burning conditions, since the cross-sectional shape of the flame-producing section of the wick is made noncircular, the amount of projection by which the flame-producing section protrudes from the wick holder can be reduced because the surface area per unit length is larger when the cross-sectional shape is an elliptical, square or other noncircular shape than when it is a circular shape. By this, the degree of design freedom in conjunction with the closure cap and the like is enhanced and a compact configuration can be realized.

In the case of fabricating a cigarette lighter, fire-lighting device or other such burner using a liquid fuel composed mainly of alcohol and equipped with the aforesaid wick, however, the initial flame length immediately after lighting, the time for the flame length to reach 25 mm, and the saturated flame length with passage of time after lighting are affected by the size, shape and material of the wick. Liquid fuel is drawn up from the tank through the draw-up section of the wick and conveyed to the flame-producing section and vaporizes from the surface thereof. When the vaporized liquid fuel is lit, it mixes with secondary air and burns with flaming. It was discovered that, owing to this process, the characteristics of the flaming combustion are affected by the surface area of the portion of the wick projecting from the wick holder.

In order for the aforesaid burner wick to achieve a burning state satisfying the conditions set out above, it is necessary to secure a certain amount of wick surface area. This can be achieved by making the cross-sectional shape of the wick noncircular so as to expand the surface area, in which case the amount of projection of the wick from the wick holder can be reduced and the wick can be disposed within a prescribed space.

Specifically, if the wick design is considered on the assumption that the aforesaid burning conditions are satisfied by, for example, a wick of circular cross section having a diameter D of ϕ4 mm and a projection length L from the wick holder of 5 mm, the calculated surface area of the wick becomes:

$$\tfrac{1}{4}\pi D^2+\pi D\times L=\tfrac{1}{4}\times 3.14\times 4^2+3.14\times 4\times 5=75.4\ \text{mm}^2.$$

On the other hand, in order to keep the three characteristics (i.e., the initial flame length etc.) the same as those of the aforesaid wick and burner (i.e., to keep the surface area the same) with a wick having a square cross-sectional shape of 4 mm×4 mm, the required projection length L becomes:

$$L=(75.4-4\times 4)/(4\times 4)=3.7\ \text{mm}$$

meaning that the projection length L can be shortened to 3.7 mm. In designing a compact fire-lighting device or other such burner, this is advantageous when consideration is given to the structure for sealing the wick during nonuse.

The flame-producing section of the wick is preferably made of heat-resistive fiber, for instance, glass fiber, ceramic fiber or carbon fiber.

This is because the wick must be constituted of a porous, heat-resistive material in order draw up the liquid fuel and vaporize it from the surface thereof and also because it requires liquid fuel retentivity owing to the need to supply fuel from the interior as fuel volatilizes from the surface. Constituting it of heat-resistive fiber is therefore effective, and glass fiber, ceramic fiber and carbon fiber are appropriate as specific materials.

Specifically, when the fiber packing density is made 150 mg/cm$^3$, the volume of the flame-producing section of a wick of circular cross-sectional shape made of glass fiber having a projection length L from the wick holder of 5 mm is:

$$\tfrac{1}{4}\pi D^2\times L=\tfrac{1}{4}\times 3.14\times 4\times 4\times 5=62.8\ \text{mm}^3.$$

The alcohol retention per unit volume of this glass fiber wick is 0.6 mg/mm$^3$ and the alcohol retention of the portion of the wick projecting from the wick holder wall is:

$$62.8\ \text{mm}^3\times 0.6\ \text{mg/mm}^3=38\ \text{mg}.$$

When the packing density of ceramic fiber is made 200 mg/cm$^3$, and a wick of square cross-sectional shape (W4 mm×T4 mm) made of ceramic fiber is given a projection length L from the wick holder of 4 mm, the volume of the projecting flame-producing section is:

$$W\times T\times L=4\times 4\times 4=64\ \text{mm}^3.$$

Since the alcohol retention per unit volume of the ceramic fiber wick is 1.1 mg/mg$^3$, the alcohol retention of the portion of this wick projecting from the wick holder is:

$$64\ \text{mm}^3 1.1\ \text{mg/mg}^3=70\ \text{mg}.$$

The fact that the wick has a large alcohol retention makes the wick advantageous as regards replenishment of fuel consumed by drying or burning.

The area of the portion of the wick projecting from the wick holder is preferably made not greater than 170 mm$^2$ and not less than 30 mm$^2$. A surface area in the range of 30 mm$^2$–170 mm$^2$ is particularly preferable.

By making the surface area of the projecting portion of the wick not greater than 170 mm$^2$, the saturated flame length can be made not greater than 70 mm. The reason is as follows. Although the flame length immediately after lighting grows to the saturated flame length as time passes after lighting of the burner wick, the saturated flame length is, as shown by the tests discussed later, correlated to the surface area of the exposed portion of the wick projecting from the wick holder and the exposed surface area of the wick contributing to combustion has to be limited to keep the saturated flame length at or under the desired length. The maximum surface area for this is 170 mm$^2$.

Further, by making the surface area of the projecting portion of the wick 30 mm$^2$ or greater, the initial flame length immediately after lighting can be made 20 mm or greater and the time for the flame length to reach 25 mm after lighting can be made 10 seconds or less. The reason for this is as follows. In this lighter, to make the initial flame length immediately after lighting the wick long and to make the time for the flame length to reach 25 mm short, that is, to achieve, as the required characteristics of a practical fire-lighting device, an initial flame length immediately after lighting of 20 mm or greater and a period of 10 seconds or less for the flame length to reach 25 mm after lighting, it is necessary, in light of the relationship with the surface area of the exposed portion of the wick projecting from the wick holder, to make the surface area not less than 30 mm$^2$.

In the case of a wick made of ceramic fiber, the preferable surface area is not less than 40 $mm^2$ and is particularly in the range of 40 $mm^2$–170 $mm^2$. By this, the saturated flame length can be made not greater than 60 mm–70 mm, the initial flame length immediately after lighting can be made from 20 mm up to around 45 mm, and the period for the flame length to reach 25 mm after lighting can be made under around 10 seconds. The practical functions as a fire-lighting device can therefore be fulfilled.

The wick can be made by bundling heat-resistive fibers or by shaping or felting heat-resistive fibers added with a small amount of binder.

It is also possible to divide the wick between the draw-up section and the flame-producing section and make at least one of the divided sections movable to contact and separate from the other, so that fuel is supplied from the draw-up section to the flame-producing section during contact and fuel supply is cut off during separation to burn only a prescribed quantity of fuel.

When, in this way, the structure is such that the flame-producing section of the wick is separated from the draw-up section at the time of lighting, i.e., when adopting a rationed burning system in which the flame is extinguished upon complete burning of the fuel retained in the wick, it is possible, by selecting the shape and material of the wick, which affect the amount of fuel retained thereby and the amount of fuel consumed, to obtain a specific rationed burning period and specific burning characteristics.

Therefore, by selecting the shape of the wick of the liquid fuel burner, including the noncircular cross-dimensional shape of the flame-producing section, and the material thereof, it is possible to design wicks for burners suitable for various applications.

Specifically, in order for a wick to continue stable burning, fuel must be supplied from the interior to the surface of the wick flame-producing section. This requires liquid fuel to be retained in the interior of the wick. As the amount of fuel retained by the wick differs depending on the constitution of the wick, the wick has to be designed taking into account the amount of fuel consumed from the wick surface area per unit time. Therefore, when adopting the rationed burning system of dividing the wick at the time of lighting, it is necessary to estimate the time from lighting to extinguishment and to determine the amount of fuel retained in accordance with the amount of fuel consumed from the surface area of the wick per unit time during this period. The desired rationed burning period and burning characteristics can be obtained by appropriately determining this amount.

The wick of the foregoing type according to the invention can have its fuel draw-up section and flame-producing section formed integrally of the same material or have its fuel draw-up section and flame-producing section formed of different materials and connected together.

As the liquid fuel composed mainly of alcohol, there can, for example, be used one having a lower monovalent alcohol, namely, methyl alcohol, ethyl alcohol or propyl alcohol, as its main component and having mixed therewith a saturated hydrocarbon such as hexane or heptane for coloring the flame.

BEST MODE FOR CARRYING OUT THE INVENTION

Embodiments of the wick for a liquid fuel burner according to the invention will be explained in the following with reference to the drawings.

<First Embodiment>

Figure 1:
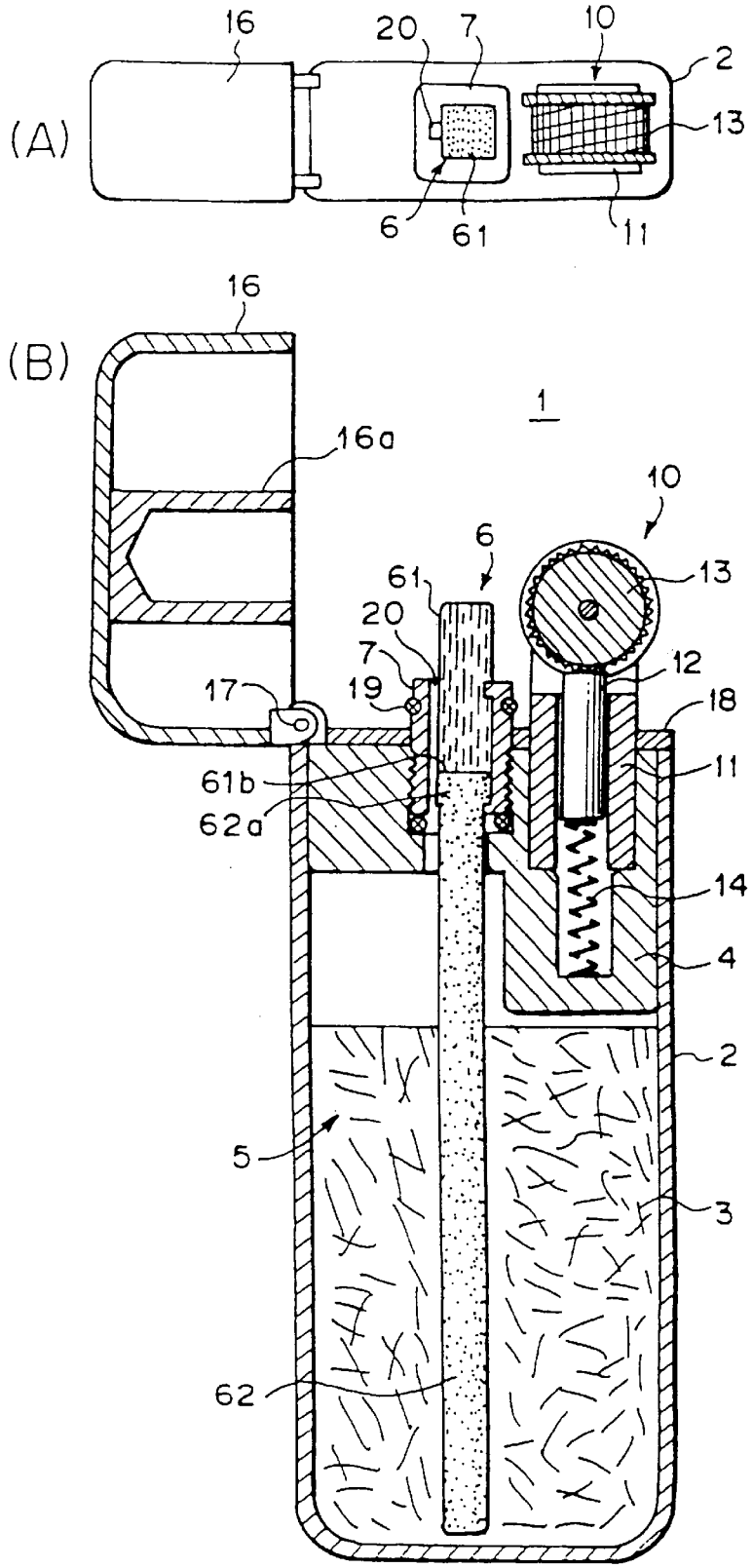
FIG. 1 shows a plan view and a schematic sectional view of a cigarette lighter as an example of a burner in a first embodiment of the invention.

FIG. 1 shows a plan view and a schematic sectional view of a cigarette lighter as an example of a liquid fuel burner. A lighter 1 has a fuel tank 2 of cylindrical shape with closed bottom. Fiber material 3 (stuffing) is inserted into the interior of the fuel tank 2 and a top cover 4 is fixed to the upper portion of the fuel tank 2 to constitute a fuel reservoir section 5 for storing liquid fuel.

The tank 2 is, for example, provided as a shaped article made of polypropylene with an inner volume of 5 $cm^3$. The fiber material 3 is polypropylene fiber of a thickness of 6 denier compacted in the tank 2 to a density of 0.05 $g/cm^3$. 4 g of liquid fuel, a mixture of 95 wt % ethyl alcohol and 5 wt % n-hexane, is poured and impregnated into this fiber material 3 for storage therein.

A wick 6 retained in a wick holder 7 is disposed to pass vertically into the tank 2 through the top cover 4. The wick 6 is formed separately of different materials at an upper wick 61 and a lower draw-up section 62 and the two are joined with the lower end portion of the upper wick 61 and the upper end portion of the draw-up section 62 in a contacted state by a box-like metal wick holder 7 whose cross-sectional shape is a square measuring 4 mm per side at the inner surface.

The lower end portion of the draw-up section 62 contacts the fiber material 3 in the tank 2 and draws up the liquid fuel impregnated in the fiber material 3 utilizing capillarity. The wick tip flame-producing section of upper wick 61 of the wick 6 projecting upward from the wick holder 7 is lit to burn and generate a flame.

The upper wick 61 is constituted, for example, by adding a small amount of organic binder to 2.8 $\mu$m-diameter ceramic fibers obtained by fiberizing a raw material composed mainly of alumina and silica, forming the fibers into a 4 mm-thick plate having a fiber packing density of 200 $mg/cm^3$, cutting a 4 mm-wide, 10 mm-long rod from the plate and inserting the rod in the wick holder 7. The length of the flame-producing section of the upper wick 61 projecting from the wick holder 7 is 3.7 mm, the surface area of the projecting flame-producing section is 75.2 $mm^2$ and the volume thereof is 59.2 $mm^3$. The flame-producing section of the upper wick 61 projecting from the wick holder 7 holds 65.1 mg of liquid fuel.

The draw-up section 62 is formed as a rod having a large-diameter head portion 62*a* by bundling and bonding acrylic fibers, the head portion 62*a* is inserted into the bottom of the wick holder 7 to make contact with the lower end 61*b* of the upper wick 61, and the upper end portion and lower end portion of the wick holder 7 are caulked in this state, whereby the upper wick 61 and the draw-up section 62 are integrally joined.

The draw-up section 62 is formed, for instance, to have a head outer diameter of 3.4 mm and length of 3 mm and a lower leg portion outer diameter of 3.0 mm and length of 37 mm. The thickness of the acrylic fibers is 3 denier and their void ratio after bonding and shaping is 60%.

An igniter 10 is installed on the top cover 4 to face the tip of the upper wick 61. A bracket 11 of the igniter 10 fixed to the top cover 4 has a flint 12 inserted therein to be vertically movable and a rotating striker wheel 13 is provided on an upper cover of the bracket 11. The tip of the flint 12 is pressed onto the peripheral surface of the rotating striker wheel 13 by the energizing force of a flint pusher spring 14 and rotation of the rotating striker wheel 13 causes sparks to fly toward the wick 6.

A closure cap 16 for evaporation prevention is provided to openably/closably cover the upper wick 61 together with the protruding portion of the wick holder 7. This closure cap 16 is rotatably pivoted by a pin 17 at one end portion of the upper surface of the top cover 4 of the tank 2. At the inner surface of the closure cap 16 is provided an inner cover 16*a* for enclosing the outer periphery of the wick holder 7 and covering/sealing the upper wick 61. An O-ring 19 is horizontally attached to the outer peripheral root portion of the wick holder 7 and the inner peripheral surface of the inner cover 16*a* presses thereon to enhance the sealing property. A face plate 18 is provided on the upper surface of the top cover 4.

In the wick holder 7 is provided a 1 mm square air passage 20 that is located inward of the inner cover 16*a* when the closure cap 16 is closed and communicates the fuel reservoir section 5 in the fuel tank 2 with the outside.

Figure 2:
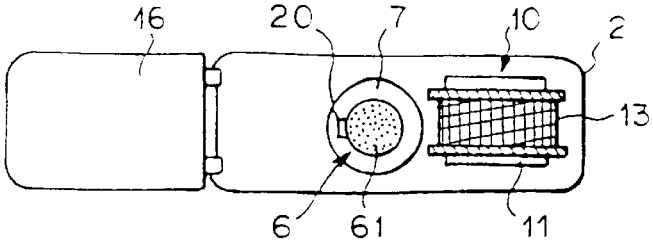
FIG. 2 is a plan view of a cigarette lighter for comparison.

FIG. 2 a top view of the structure of a cigarette lighter prepared for comparison with the lighter in the first embodiment.

The cross-sectional shape of the upper wick 61 of the wick 6 of this comparative lighter is circular and the wick holder 7 holding it is formed to be cylindrical (inner diameter $\phi$ of 4 mm). Other aspects of the structure are the same as shown in FIG. 1.

This upper wick 61 is constituted, for example, by adding a small amount of organic binder to 2.8 $\mu$m-diameter ceramic fibers obtained by fiberizing a raw material composed mainly of alumina and silica, forming the fibers into a body having a fiber packing density of 200 $mg/cm^3$ and outer diameter $\phi$ of 4 mm, and inserting the body in the wick holder 7. The length of the flame-producing section of the upper wick 61 projecting from the wick holder 7 is 5 mm, the surface area of the flame-producing section is 75.4 $mm^2$ and the volume thereof is 62.8 $mm^3$. The flame-producing section of the upper wick 61 holds 69.1 mg of liquid fuel.

Cigarette lighters like those of FIGS. 1 and 2 were used and the change in flame length over 2 minutes of continuous burning after lighting was measured. With the comparative cigarette lighter (FIG. 2) having the wick of circular cross section (amount of projection: 5 mm), the flame length immediately after lighting was 27 mm, grew gradually to 47 mm at 30 seconds after lighting, and then assumed a state of equilibrium with no change in flame length. On the other hand, with the invention cigarette lighter (FIG. 1) having the square cross section (amount of projection 3.7 mm), the flame length immediately after lighting was 27 mm, grew gradually to 47 mm at 30 seconds after lighting, and then assumed a state of equilibrium with no change in flame length, i.e., the results obtained were the same as those for the comparative example.

In other words, in the case of invention wick 6, the length of the flame-producing section of the upper wick 61 projecting from the wick holder 7 was shortened to 3.7 mm from the 5 mm of the comparative example but a flame length change property satisfying the required burning conditions of a cigarette lighter were obtained because the square cross-sectional shape provided substantially the same exposed surface area.

How the flame length change property varies with the surface area of the flame-producing section of the aforesaid type will be explained in Test 2 set out below.

<Second Embodiment>

Figure 3:
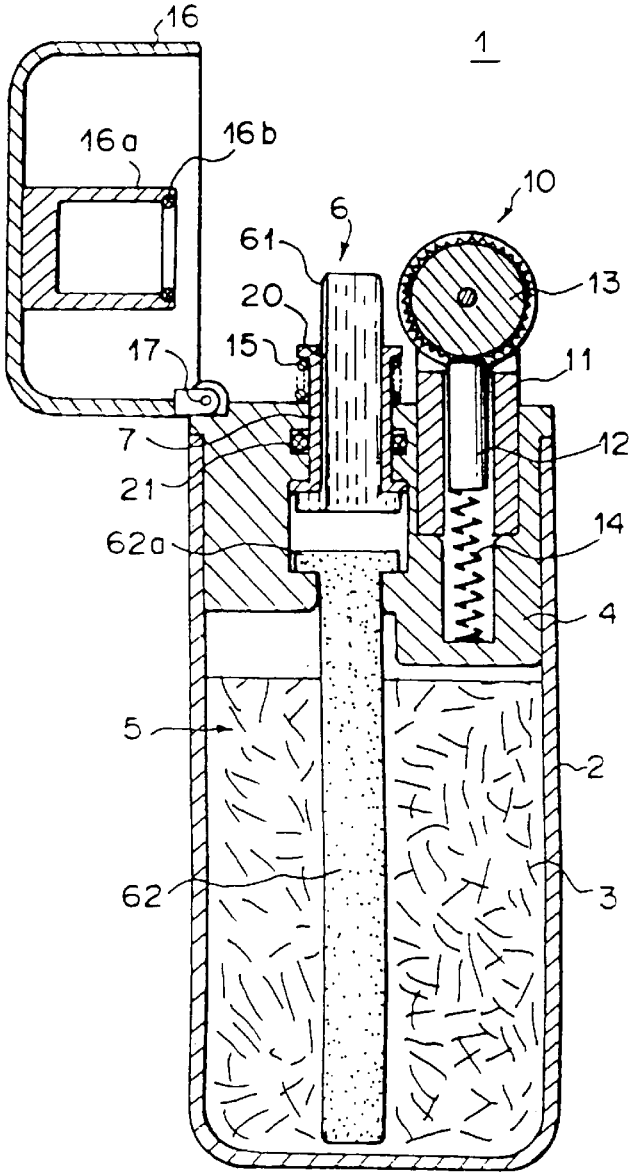
FIG. 3 is schematic sectional view of a cigarette lighter in a second embodiment of the invention.

This embodiment, shown in FIG. 3, is a cigarette lighter of rationed burning type structured to enable separation of the upper wick and draw-up section of the wick so as to effect automatic extinguishment after burning for a specific period of time following lighting.

An upper wick 61 of a wick 6 has a square cross section and is supported by a top cover 4 via a wick holder 7 to be vertically slidable. On the other hand, a draw-up section 62 has its head portion 62*a* fixed to the top cover 4 and its lower end inserted into a fuel reservoir section 5. As the upper wick 61 slides vertically, its lower end moves in and out of contact, i.e., between a touching state and a separated state, with the upper end of the draw-up section 62.

The upper wick 61 and the wick holder 7 are biased in the separating direction (upward) by a coil spring 15 as an elastic means. The coil spring is inserted in a compressed state between the upper surface of the top cover 4 and the upper end of the wick holder 7. When the upper wick 61 moves upward under the force of the coil spring 15, its lower end separates from the upper end of the draw-up section 62 to form a gap between the two.

An O-ring 21 is interposed between the top cover 4 and the wick holder 7 to effect sealing between the two.

A closure cap 16 for evaporation prevention is provided to openably/closably cover the projecting portion of the upper wick 61. This closure cap 16 is rotatably pivoted by a pin 17 at one end portion of the upper surface of the top cover 4 of the tank 2. At the inner surface of the closure cap 16 is provided an inner cover 16*a* that abuts on the upper end of the wick holder 7 to cover and seal the upper wick 61. A seal member 16*b* is attached to the lower end of the inner cover 16*a* to enhance the sealing property by abutment on the upper surface of the top cover 4. Other aspects are the same as in the first embodiment shown in FIG. 1.

When the closure cap 16 is closed, the seal member 16*b* at the lower end of the inner cover 16*a* abuts on the upper end of the wick holder 7 and presses it down against the force of the coil spring 15, thereby bringing the lower end of the upper wick 61 in contact with the upper end of the draw-up section 62 to supply fuel to the upper wick 61, and also sealing the flame-producing section of the upper wick 61 to prevent evaporation of liquid fuel.

When the closure cap 16 is opened for lighting and use, the force of the coil spring 15 moves the upper wick 61 upward together with the wick holder 7, whereby the lower end thereof separates from the upper end of the draw-up section 62 and cuts off the supply of fuel to the upper wick 61. When the flame-producing section of the upper wick 61 is lit in this state, rationed burning is effected in which the flame is extinguished when the fuel retained in the upper wick 61 has been completely burned.

When the upper wick 61 is formed to have a square 4 mm×4 mm cross-sectional shape and a length of 10 mm, the volume of the whole upper wick 61 is 160 $mm^3$ and this portion holds 176 mg of liquid fuel. The length of projection from the wick holder 7 is 3.7 mm.

The cigarette lighter of this embodiment was used and the change in flame length after lighting was measured. The flame length immediately after lighting was 27 mm, grew gradually to 47 mm at 30 seconds after lighting, and then assumed a state of equilibrium with no change in flame length. At 40 seconds after lighting, the flame length abruptly shortened and spontaneously went out at about 44 seconds.

Figure 11:
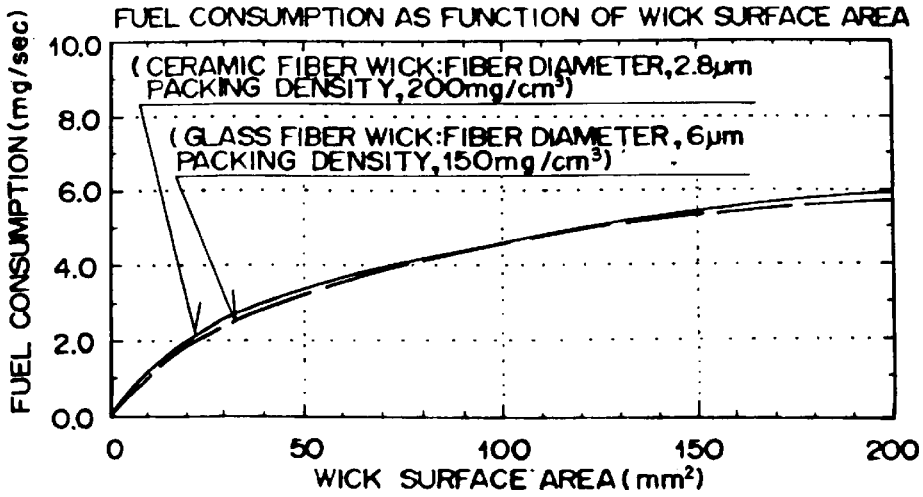
FIG. 11 is a graph showing how fuel consumption varies with wick surface area.

How the burning period in such rationed burning is designed will be explained. FIG. 11 shows how fuel consumption during burning varies with surface area of the flame-producing section of a glass fiber wick and a ceramic wick. It can be seen from FIG. 11 that fuel consumption and surface area are interrelated and that the fuel consumptions of glass fiber and ceramic fiber materials differ little, i.e., exhibit substantially the same values.

The wick of the Second Embodiment is a ceramic fiber wick whose upper wick length is 10 mm, protrusion length from the wick holder is 3.7 mm, amount of retained fuel alcohol is 176 mg, and flame-producing section surface area is 75.2 $mm^2$. Its fuel consumption per second, as found from FIG. 11, is therefore about 4 mg, meaning that the burning period required to completely burn the 176 mg of fuel comes to about 44 seconds. In contrast, as regards rationed burning effected using, for example, a flame-producing section structure having a glass fiber wick of circular cross-section whose wick length is 10 mm and whose flame-producing section projects by a length of 5 mm from the wick holder, the amount of retained fuel alcohol is 75.4 mg, the wick surface area is 75.4 $mm^2$ and the fuel consumption per second, as found from FIG. 11, is about 4 mg. This figures out to about 19 seconds for complete burning of the 75.4 mg of fuel.

The cross-sectional shape of the tip flame-producing section of the wick in the lighter or other burner according to the invention is noncircular. Possible configurations include elliptical and other noncircular shapes in addition to the square shape of the foregoing embodiments. In short, the noncircular cross section is adopted to increase the surface area of the flame-producing section projecting from the wick holder. Tests carried out to ascertain how burning characteristics (flame length change property) vary with surface area will now be explained.

Figure 4:
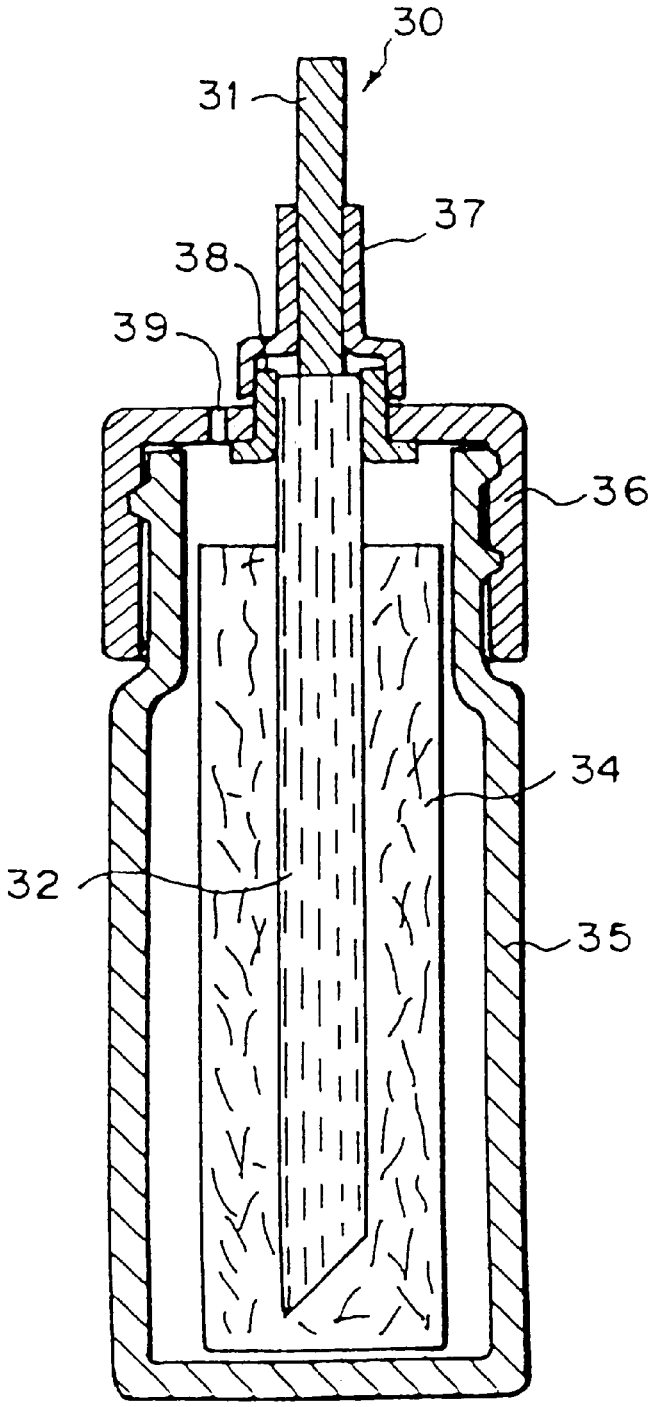
FIG. 4 is a sectional view of a basic sample of a burner used in tests.

The burner used as the reference sample for conducting the tests is shown in FIG. 4. Stuffing 34 for impregnation with liquid fuel composed mainly of alcohol is packed in a vessel 35 serving as a fuel tank, the draw-up section 32 of a wick 30 is inserted into contact with the stuffing 34, and an upper cover 36 is fitted over the opening of the vessel 35. A jig holder 38 supporting the upper end of the draw-up section 32 is fastened at the center of the upper cover 36. A wick retaining jig 37 is attached to the top of the jig holder 38 to serve as a wick holder for retaining the flame-producing section 31 of the wick 30. The upper end of the draw-up section 32 is thus connected to the lower end of the flame-producing section 31.

As the flame-producing section 31 of the wick 30, there were used glass fiber wicks made of bundled glass fibers and ceramic fiber wicks. Flame-producing sections 31 of appropriately selected fiber diameters and void ratios were connected to the draw-up section 32 made of acrylic fibers, which draw-up section 32 had a replenishment capability equal to or greater than the amount of consumption by burning at the flame-producing section.

Although glass fiber wicks with a fiber diameter of 6 $\mu$m and a fiber density of 150 $mg/cm^3$ were used, fibers with dimensional conditions on either side of these can also be used insofar as the ability to supply fuel matched to the fuel consumption at the wick surface is satisfactory. Although ceramic fiber wicks with a fiber diameter of 2.8 $\mu$m and a fiber density of 200 $mg/cm^3$ were used, the same can also be said about these. Although the tests were conducted using specific glass fibers and ceramic fibers, the results can be similarly applied even if other materials are used insofar as the heat resistance and draw-up/dispersion capability are the same.

Burning tests as in Test 1 and Test 2 below were conducted in which the glass fiber wicks and ceramic fiber wicks constituting the flame-producing sections 31 were prepared in various dimensions (diameters and lengths), wick retaining jigs 37 of corresponding shapes were prepared, and the protrusion length and surface area of the exposed portion were varied. The liquid fuel described regarding the First Embodiment was used.

<Test 1>

As wicks were used ones of 6 $\mu$m-diameter glass fibers and ones of 2.8 $\mu$m-diameter ceramic fibers composed mainly of alumina and silica, each type being formed in a round cross-sectional shape of an outer diameter $\phi$ of 4 mm and a square cross-sectional shape of 4 mm×4 mm. They were incorporated in the test lighter shown in FIG. 4 and, with the projected length of the upper wick from the wick holder set to 3 mm and 5 mm, were subjected to comparison measurement of required characteristics in terms of flame length change with ignition and burning.

In the case of the glass fiber wicks, the fibers were given a fiber density of 150 $mg/cm^3$ and fabricated as shaped bundles in round and square cross-sectional shapes of $\phi$4 mm and 4 mm×4 mm, wick holders for retaining them were fabricated, and wicks whose projection lengths from the wick holder were 3 mm and 5 mm were subject to testing as test samples.

In the case of the ceramic fiber wicks, organic binder was added to the 2.8 $\mu$m-diameter ceramic fibers, the fibers were formed into a 4 mm-thick plate having a fiber packing density of 200 $mg/cm^3$, and, as in the case of the glass fiber wicks, wicks were fabricated in round and square cross-sectional shapes of $\phi$4 mm and 4 mm×4 mm for use as test samples. These were also similarly given projection lengths from the wick holder of 3 mm and 5 mm.

Lighting and burning was conducted with respect to the wick of each test sample and the change in flame length was measured. The results are shown in Table 1.

TABLE 1

| Size, Shape | Material | Glass fiber All 6.0 μm | Glass fiber 150 mg/cm³ | Ceramic fiber All 2.8 μm | Ceramic fiber 200 mg/cm³ |
|---|---|---|---|---|---|
| | | Projection 3.0 mm | | | |
| Cross section Circular 4mmφ | Surface area 50.2 mm² | Initial flame length | 25 mm | Initial flame length | 20 mm |
| | | Rise time | 0 sec | Rise time | 2 sec |
| | | Saturated flame length | 40 mm | Saturated flame length | 40 mm |
| Cross section Square 4 mm × 4 mm | Surface area 64.0 mm² | Initial flame length | 28 mm | Initial flame length | 24 mm |
| | | Rise time | 0 sec | Rise time | 1 sec |
| | | Saturated flame length | 48 mm | Saturated flame length | 50 mm |
| | | Protection 5.0 mm | | | |
| Cross section Circular 4mmφ | Surface area 75.4 mm² | Initial flame length | 30 mm | Initial flame length | 31 mm |
| | | Rise time | 0 sec | Rise time | 0 sec |
| | | Saturated flame length | 45 mm | Saturated flame length | 48 mm |
| Cross section Square 4 mm × 4 mm | Surface area 96.0 mm² | Initial flame length | 32 mm | Initial flame length | 35 mm |
| | | Rise time | 0 sec | Rise time | 0 sec |
| | | Saturated flame length | 55 mm | Saturated flame length | 53 mm |

The value of the measured amount of contained fuel alcohol retained per unit volume by the glass fiber ones bundled to have a fiber packing density of 150 mg/cm$^3$ was 0.6 g/cm$^3$. On the hand, amount of similarly contained fuel alcohol retained per unit volume by the ceramic fiber ones formed to have a fiber packing density of 200 mg/cm$^3$ was 1.1 g/cm$^3$. The amount of retained fuel thus differed greatly between the two.

Against the backdrop of the differing characteristics between the glass fiber wicks and the ceramic fiber wicks, when a look is taken at the initial flame length immediately after lighting, the time for the flame length to reach 25 mm and the saturated flame length, which are the required wick characteristics in Table 1, it is found that they differ in these characteristics, and, when a look is taken at the influence of the surface area for the case of a circular cross section of diameter $\phi$ of Dmm and a projection length from the upper end of the wick holder of Lmm simply calculated as $\frac{1}{4}\pi D^2+\pi D\times L$ and at the influence of the simply calculated surface area of $W^2+4W\times L$ in the case of a square cross-sectional shape of W per side, it is found that, despite the microscopically viewed surface states being porous and made bumpy and rough by tiny pores and the wick surface state therefore differing depending on the constituent material, the aforesaid surface area simply calculated from the external dimensions affects the three characteristics notwithstanding that the constituent materials of the wicks differ.

<Test 2>

Taking the foregoing test results into account, tests were conducted on glass fiber wicks and ceramic fiber wicks to measure flame length property change with wick dimensions and shape in greater detail.

Figure 5:
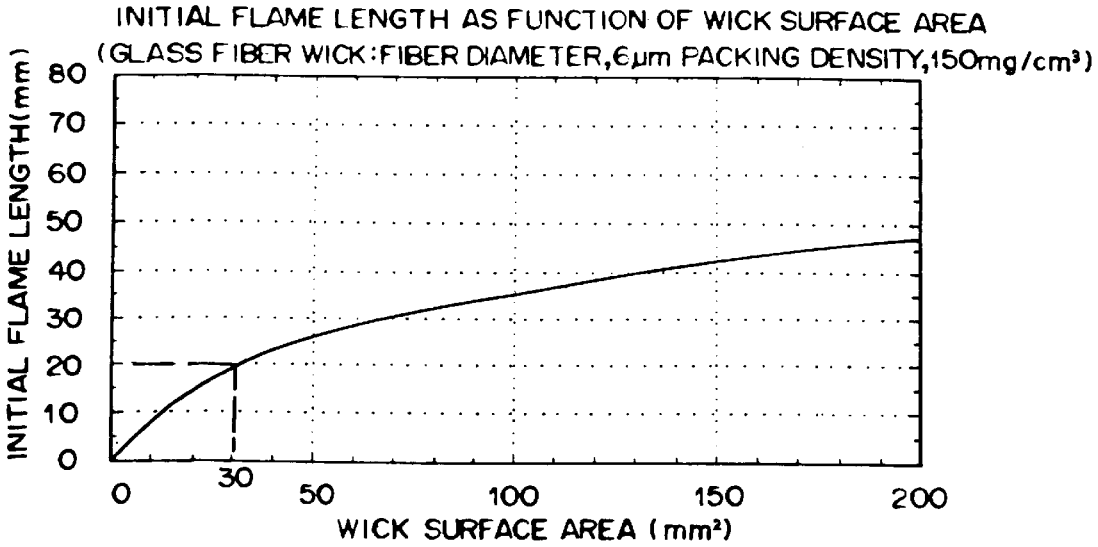
FIG. 5 is a graph showing how initial flame length varies with wick surface area in the case of a glass fiber wick.
Figure 6:
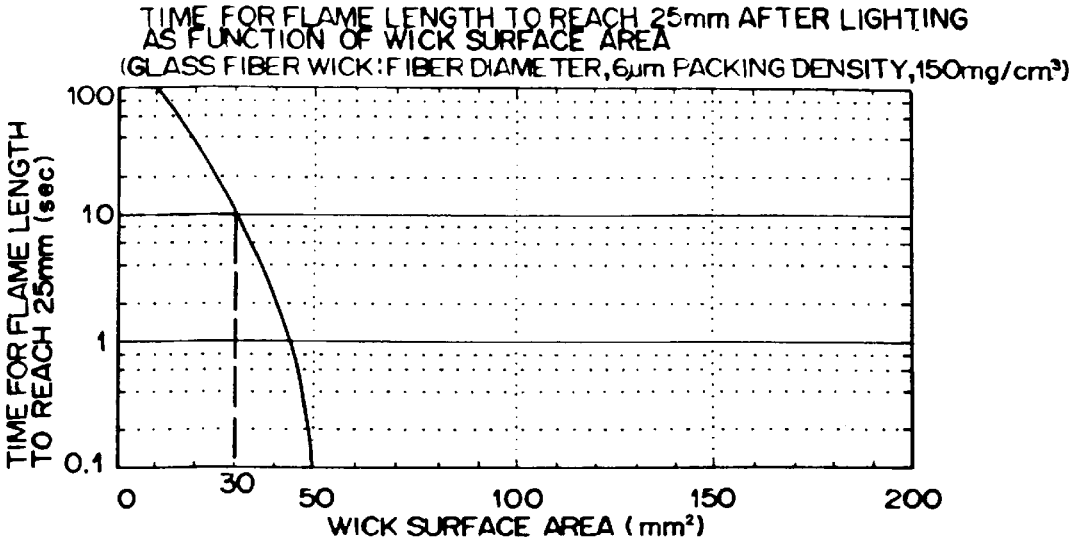
FIG. 6 is a graph showing how time for the flame length to reach 25 mm varies with wick surface area in the case of a glass fiber wick.
Figure 7:
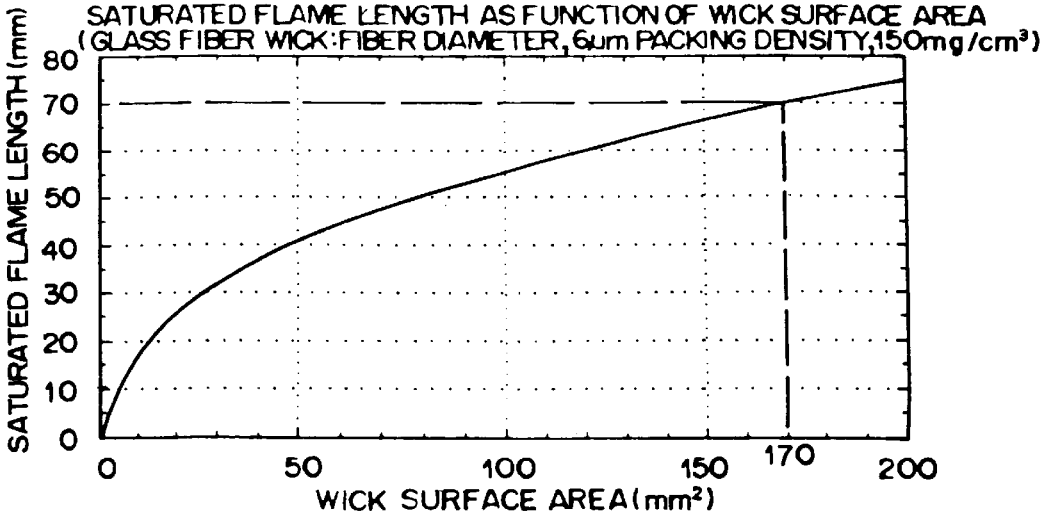
FIG. 7 is a graph showing how saturated flame length varies with wick surface area in the case of a glass fiber wick.

The measured characteristics for glass fiber wicks of circular cross-sectional shape and varied in outer diameter in the range of $\phi$1 mm–$\phi$5 mm and in protrusion length from the wick holder in the range of 1 mm–9 mm and the results calculated regarding the influence of the wick surface area as simply calculated from the wick outer diameter and projection length are shown in FIGS. 5, 6 and 7.

Figure 8:
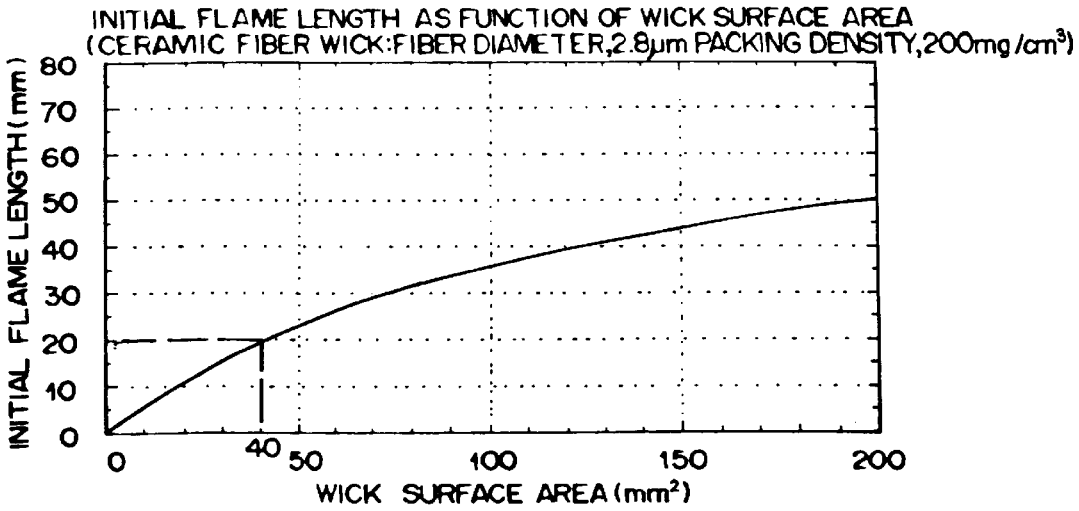
FIG. 8 is a graph showing how initial flame length varies with wick surface area in the case of a ceramic fiber wick.
Figure 9:
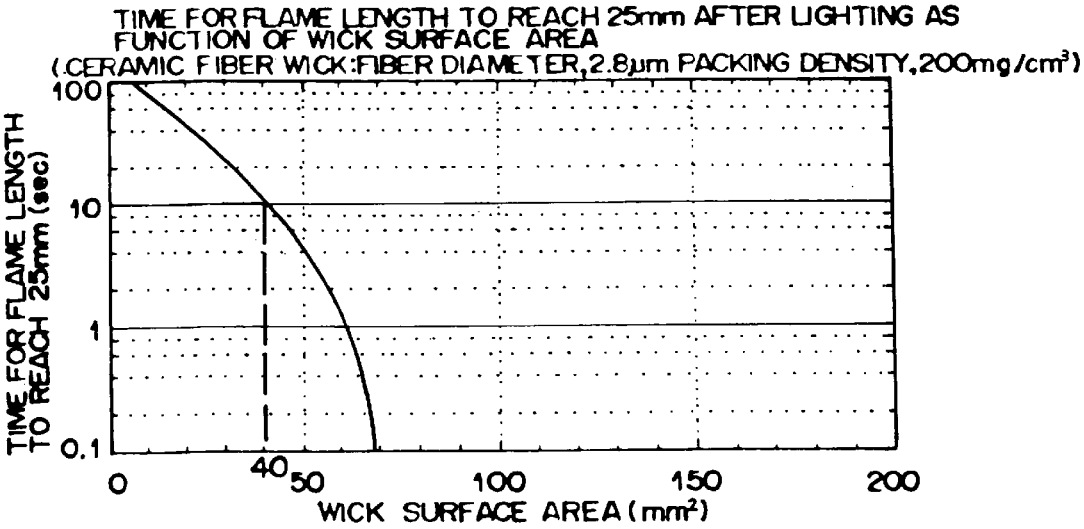
FIG. 9 is a graph showing how time for the flame length to reach 25 mm varies with wick surface area in the case of a ceramic fiber wick.
Figure 10:
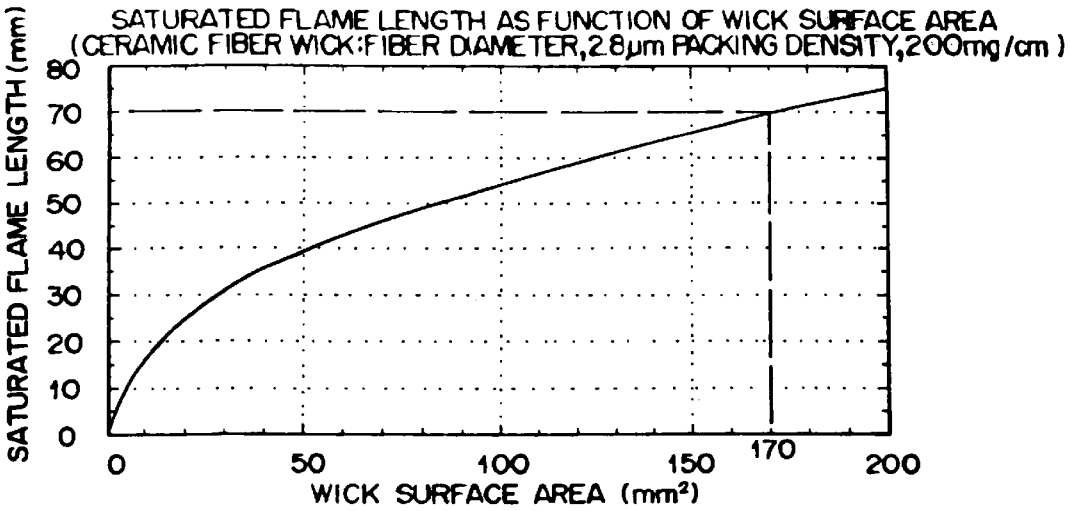
FIG. 10 is a graph showing how saturated flame length varies with wick surface area in the case of a ceramic fiber wick.

The measured characteristics for ceramic fiber wicks of 3 mm thickness and varied in plate width in the range of 1 mm–5 mm and in protrusion length from the wick holder in the range of 1 mm–9 mm and the results calculated regarding the influence of the wick surface area as simply calculated from the wick dimensions and projection length are shown in FIGS. 8, 9 and 10.

From FIGS. 5, 6, 7 ,8, 9 and 10 it can be seen that wicks having the same constituent material and the same surface area calculated simply from the outer dimensions exhibit the same characteristics within the range enabling practical use as the wick of such a fire-lighting device.

Utilizing this phenomenon, it is possible, by changing the cross-sectional shape from circular to noncircular, e.g., to square or elliptical, to enlarge the outer peripheral dimensions thereof, so that, where the surface area is to be kept the same, the projection length from the wick holder can be shortened.

Although the actual surface areas of the wicks can be considered to be larger because, viewed microscopically, the surfaces of all wicks utilizing glass fibers and ceramic fibers are rough, the surface areas are here shown, with respect to the measured values, as the exposed surface areas beyond the support portion of the wick calculated simply from the side surface areas and the tip surface areas based on the outer dimensions thereof.

Specifically, FIG. 5 shows how initial flame length varies with wick surface area in the case of a glass fiber wick. A flame-producing section surface area of not less than 30 mm$^2$ is necessary for obtaining an initial flame length of not less than 20 mm. From this figure it can be concluded that when the surface area of the wick is 100 mm$^2$, the initial flame length is about 35 mm when the shape and dimensions are within the tested range, and that even when the dimensions are enlarged to make the surface area 170 mm$^2$, the initial flame length is about 40 mm, which can be considered a practically suitable flame length for a fire-lighting device.

FIG. 6 shows the measured results for wick surface area versus time for the flame length to reach 25 mm, also in the case of a glass fiber wick. A surface area of not less than 30 $mm^2$ is necessary for making this time under around 10 seconds.

FIG. 7 shows the measured results for wick surface area versus saturated flame length after flame length growth to equilibrium following lighting, also in the case of a glass fiber wick. At the foregoing wick surface area of 170 $mm^2$, the saturated flame length is 65 mm and for keeping the saturated flame length to not greater than 60 mm–70 mm, it suffices to make the surface area not greater than this. In a cigarette lighter or like application in which it is preferable to make the saturated flame length not greater than 50 mm–60 mm, the wick surface area should be kept to 100 $mm^2$ or less.

FIGS. 8 to 10 show the test results for wicks using ceramic fibers. FIG. 8 shows how initial flame length varies with wick surface area. A flame-producing section surface area of not less than 40 $mm^2$ is necessary for obtaining an initial flame length of not less than 20 mm. When the dimensions are enlarged to make the wick surface area 170 $mm^2$, the initial flame length is about 45 mm, which is somewhat long and can be considered about the limit of the flame length of a fire-lighting device. When the surface area is 100 $mm^2$, the initial flame length is about 35 mm, which, depending on the purpose of use and particularly in a cigarette lighter, can be considered to be the upper limit of an appropriate flame length.

FIG. 9 shows the measured results for wick surface area versus time for the flame length to reach 25 mm, also in the case of a ceramic fiber wick. A surface area of not less than 40 $mm^2$ is necessary for making this time under around 10 seconds.

FIG. 10 shows the measured results for wick surface area versus saturated flame length, also in the case of a ceramic fiber wick. At the foregoing wick surface area of 170 $mm^2$, the saturated flame length is 65 mm and for keeping the saturated flame length to not greater than 60 mm–70 mm, it suffices to make the surface area not greater than this. In a cigarette lighter or like application in which it is preferable to make the saturated flame length not greater than 50 mm–60 mm, the wick surface area should be kept to 100 $mm^2$ or less.

The aforesaid test results show that, with a glass fiber wick or a ceramic fiber wick, it is possible by limiting the surface area and shape of the wick to within the aforesaid ranges to obtain a wick for a liquid fuel burner using liquid fuel composed mainly of alcohol that exhibits good burning characteristics.

While the fiber diameters of the glass fibers and ceramic fiber have been expressed numerically, it should be noted that these are typical average diameters and that the actual diameters have distributions relative to the indicated fiber diameters, i.e., the indicated values are representative expressions, and various thicker and finer ones are intermixed.

What is claimed is:

1. In a liquid fuel burner including a nonconsumable wick for drawing up by capillarity of a draw-up section liquid fuel composed mainly of alcohol contained in a fuel tank and for burning it up at a tip flame-producing section, a wick holder for holding the wick with a flame-producing section of predetermined length maintained above the wick holder, an igniter for lighting the wick and a closure cap for preventing evaporation capable of sealing the wick operably and closably, a nonconsumable wick for a liquid fuel burner comprising an integral flame-producing section which is noncircular in cross-sectional shape and has a total exposed surface area above the wick holder equal to the cross-sectional area of the flame producing section added to the peripheral dimension of the flame-producing section multiplied by the predetermined length of the flame-producing section above the wick holder, whereby the stabilized flame length is achieved more quickly than with a wick having a circular cross sectional shape.

2. A wick according to claim 1 wherein the flame-producing section of the wick is elliptical in cross-sectional shape.

3. A wick according to claim 1 wherein the flame-producing section of the wick is square in cross-sectional shape.

4. A wick according to any one of claims 1, 2 and 3, wherein the flame-producing section of the wick is made of heat-resistive fiber.

5. A wick according to claim 4 wherein the heat-resistive fiber is glass fiber.

6. A wick according to claim 4 wherein the heat-resistive fiber is ceramic fiber.

7. A wick according to claim 4 wherein the heat-resistive fiber is carbon fiber.

8. A wick according to claim 1 wherein the flame-producing portion of the wick above the wick holder has a total exposed surface area of not greater than 170 $mm^2$.

9. A wick according to claim 1 wherein the flame-producing portion of the wick above the wick holder has a total exposed surface area of not less than 30 $mm^2$.

10. A wick according to claim 1 wherein the flame-producing portion of the wick projecting above the wick holder has a surface area in the range of 30 $mm^2$–170 $mm^2$.

11. A wick according to claim 6 wherein the flame-producing portion of the wick projecting above the wick holder has a surface area of not less than 40 $mm^2$.

12. A wick according to claim 11 wherein the flame-producing portion of the wick projecting above the wick holder has a surface area in the range of 40 $mm^2$–170 $mm^2$.

13. A wick according to claim 1 wherein the wick comprises a bundle of heat-resistive fibers held together with a small amount of binder.

14. A wick according to claim 1 wherein the wick is divided into a draw-up section and a flame-producing section at least one of which is movable to contact and separate from the other, fuel being supplied from the draw-up section to the flame-producing section during contact and fuel supply being cut off from the flame-producing section during separation to permit only a prescribed amount of fuel to burn.

* * * * *

UNITED STATES PATENT AND TRADEMARK OFFICE

CERTIFICATE OF CORRECTION

PATENT NO. : 6,196,832 B1
DATED : March 6, 2001
INVENTOR(S) : Mifune et al.

It is certified that error appears in the above-identified patent and that said Letters Patent is hereby corrected as shown below:

Title page,
Item [56], References Cited, U.S. PATENT DOCUMENTS, insert
-- 2,680,962 6/1954; 4,269,591 5/1981 --.
FOREIGN PATENT DOCUMENTS, insert -- 0,078,586 4/1983 (EPO) --.

Signed and Sealed this

Twenty-second Day of February, 2005

JON W. DUDAS
*Director of the United States Patent and Trademark Office*